US005603780A

United States Patent [19]

Nachtrab et al.

[11] Patent Number: 5,603,780

[45] **Date of Patent: *Feb. 18, 1997**

[54] LIGHT WEIGHT, HIGH STRENGTH BERYLLIUM-ALUMINUM ALLOY

[75] Inventors: William T. Nachtrab, Maynard; Nancy F. Levoy, Acton; Kevin R. Raftery, Boxborough, all of Mass.

[73] Assignee: Nuclear Metals, Inc., Concord, Mass.

[ * ] Notice: The term of this patent shall not extend beyond the expiration date of Pat. No. 5,421,916.

[21] Appl. No.: 402,515

[22] Filed: Mar. 10, 1995

Related U.S. Application Data

[63] Continuation-in-part of Ser. No. 117,218, Sep. 3, 1993, Pat. No. 5,421,916.

[51] Int. Cl.[6] ..... C22C 25/00

[52] U.S. Cl. ..... 148/400; 148/405; 420/401

[58] Field of Search ..... 148/400, 405; 420/401

[56] References Cited

U.S. PATENT DOCUMENTS 5,421,916 6/1995 Nachtrab et al. ..... 148/400

*Primary Examiner*—Donald E. Czaja
*Assistant Examiner*—Sean Vincent
*Attorney, Agent, or Firm*—Iandiorio & Teska

[57] ABSTRACT

A light weight, high strength ternary or higher-order cast beryllium-aluminum alloy, including approximately 60 to 70 weight % beryllium, one or both of from approximately 0.5 to 4 weight % silicon and from 0.2 to 4.25 weight % silver, with the balance aluminum. Beryllium strengthening elements selected from the group consisting of copper, nickel, or cobalt may be present at from 0.1 to 2.0 weight % of the alloy to increase the alloy strength.

9 Claims, 2 Drawing Sheets

LIGHT WEIGHT, HIGH STRENGTH BERYLLIUM-ALUMINUM ALLOY

RELATED APPLICATIONS

This application is a continuation-in-part application of U.S. Ser. No. 08/117,218 filed Sep. 3, 1993 by the same applicants, now U.S. Pat. No. 5,421,916.

FIELD OF INVENTION

This invention relates to a light weight, high strength beryllium-aluminum alloy suitable for the manufacture of precision castings or wrought material produced from ingot castings.

BACKGROUND OF INVENTION

Beryllium is a high strength, light weight, high stiffness metal that has extremely low ductility which prevents it from being cast and also creates a very low resistance to impact and fatigue, making the cast metal or metal produced from castings relatively useless for most applications.

To increase the ductility of beryllium, much work has been done with beryllium-aluminum alloys to make a ductile, two phase, composite of aluminum and beryllium. Aluminum does not react with the reactive beryllium, is ductile, and is relatively lightweight, making it a suitable candidate for improving the ductility of beryllium, while keeping the density low.

However, beryllium-aluminum alloys are inherently difficult to cast due to the mutual insolubility of beryllium and aluminum in the solid phase and the wide solidification temperature range typical in this alloy system. An alloy of 60 weight % beryllium and 40 weight % aluminum has a liquidus temperature (temperature at which solidification begins) of nearly 1250° C. and a solidus temperature (temperature of complete solidification) of 645° C. During the initial stages of solidification, primary beryllium dendrites form in the liquid to make a two phase solid-liquid mixture. The beryllium dendrites produce a tortuous channel for the liquid to flow and fill during the last stages of solidification. As a result, shrinkage cavities develop, and these alloys typically exhibit a large amount of microporosity in the as-cast condition. This feature greatly affects the properties and integrity of the casting. Porosity leads to low strength and premature failure at relatively low ductilities. In addition, castings have a relatively coarse microstructure of beryllium distributed in an aluminum matrix, and such coarse microstructures generally result in low strength and low ductility. To overcome the problems associated with cast structures, a powder metallurgical approach has been used to produce useful materials from beryllium-aluminum alloys.

There have also been proposed ternary beryllium-aluminum alloys made by powder metallurgical approaches such as liquid phase sintering. For example, U.S. Pat. No. 3,322,512, Krock et al., May 30, 1967, discloses a beryllium-aluminum-silver composite containing 50 to 85 weight % beryllium, 10.5 to 35 weight % aluminum, and 4.5 to 15 weight % silver. The composite is prepared by compacting a powder mixture having the desired composition, including a fluxing agent of alkali and alkaline earth halogenide agents such as lithium fluoride-lithium chloride, and then sintering the compact at a temperature below the 1277° C. melting point of beryllium but above the 620° C. melting point of the aluminum-silver alloy so that the aluminum-silver alloy liquifies and partially dissolves the small beryllium particles to envelope the brittle beryllium in a more ductile aluminum-silver-beryllium alloy. U.S. Pat. No. 3,438,751, issued to Krock et at. on Apr. 15, 1969, discloses a beryllium-aluminum-silicon composite containing 50 to 85 weight % beryllium, 13 to 50 weight % aluminum, and a trace to 6.6 weight % silicon, also made by the above-described powder metallurgical liquid sintering technique. However, high silicon content reduces ductility to unacceptably low levels, and high silver content increases alloy density. Therefore, the alloys cannot be successfully cast.

Other ternary, quaternary and more complex beryllium-aluminum alloys made by powder metallurgical approaches such as solid state synthesis have also been proposed. See, for example, McCarthy et at., U.S. Pat. No. 3,664,889. That patent discloses preparing the alloys by atomizing a binary beryllium-aluminum alloy to create a powder that then has mixed into it fine elemental metallic powders of the desired alloying elements. The powders are then mixed together thoroughly to achieve good distribution, and the powder blend is consolidated by a suitable hot or cold operation, carded on without any melting. These are not cast alloys and this approach is very costly.

It is known, however, that beryllium-aluminum alloys tend to separate or segregate when cast and generally have a porous cast structure. Accordingly, previous attempts to produce beryllium-aluminum alloys by casting resulted in low strength, low ductility, and coarse microstructures with poor internal quality.

SUMMARY OF INVENTION

It is therefore an object of this invention to provide an improved light weight, high strength beryllium-aluminum alloy suitable for casting.

It is a further object of this invention to provide such an alloy that can be cast without segregation.

It is a further object of this invention to provide such an alloy that can be cast without microporosity.

It is a further object of this invention to provide such an alloy that has a relatively fine as-cast microstructure.

It is a further object of this invention to provide such an alloy that has a higher strength than has previously been attained for other cast beryllium-aluminum alloys.

It is a further object of this invention to provide such an alloy that has a higher ductility than has previously been attained for other cast beryllium-aluminum alloys.

It is a further object of this invention to provide such an alloy that has a density of less than 2.2 grams per cubic centimeter (0.079 pounds per cubic inch).

It is a further object of this invention to provide such an alloy that has an elastic modulus (stiffness) greater than 28 million psi.

This invention results from the realization that a light weight, high strength and ductile beryllium-aluminum alloy capable of being cast with virtually no segregation and microporosity may be accomplished with approximately 60 to 70 weight % beryllium, one or both of approximately 0.5 to 4 weight % silicon and approximately a 0.2 to 4.25 weight % silver, and aluminum. It has been found that including both silicon and silver creates an as-cast alloy having very desirable properties which can be further improved by heat or mechanical treatment thereafter, thereby allowing the alloy to be used to cast intricate shapes that accomplish strong, lightweight stiff metal parts or cast ingots that can be rolled, extruded or otherwise mechanically worked.

This invention features a ternary or higher-order cast beryllium-aluminum alloy. A east alloy is defined as an alloy produced by casting. The cast alloy featured includes approximately 60 to 70 weight % beryllium; at least one of from approximately 0.5 to 4 weight % silicon and from 0.2 to approximately 4.25 weight % silver; and aluminum. Ternary alloys include only one of silicon or silver in the stated amount, with the balance aluminum. The quaternary alloy may contain both silver and silicon in the stated amounts. For alloys including silver, silicon, or silver and silicon, the beryllium may be strengthened by adding copper, nickel or cobalt in the amount of approximately 0.1 to 2.0 weight % of the alloy. For alloys to be used in the cast condition ductility may be improved by the addition of 0.005 to 0.200 by weight % Sr, or Sb when Si is used in the alloy. The alloy may be wrought after casting to increase ductility and strength, or heat treated to increase strength. The aluminum phase surrounds the beryllium phase. In addition, the aluminum phase contains a silicon rich phase and aluminum-silver phase.

BRIEF DISCLOSURE OF THE DRAWINGS

Other objects, features and advantages will occur to those skilled in the art from the following description of preferred embodiments and the accompanying drawings in which.

DISCLOSURE OF PREFERRED EMBODIMENT

Figure 1A:
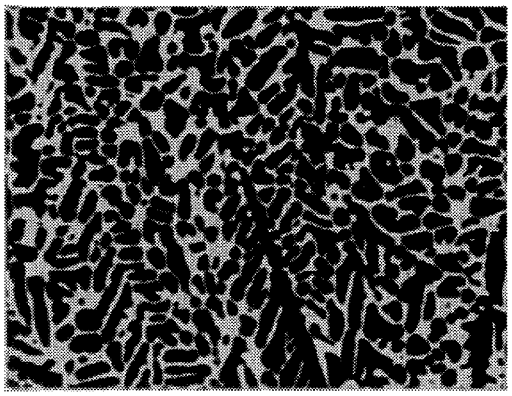
FIG. 1A is a photomicrograph of cast microstructure typical of prior art alloys.
Figure 1B:
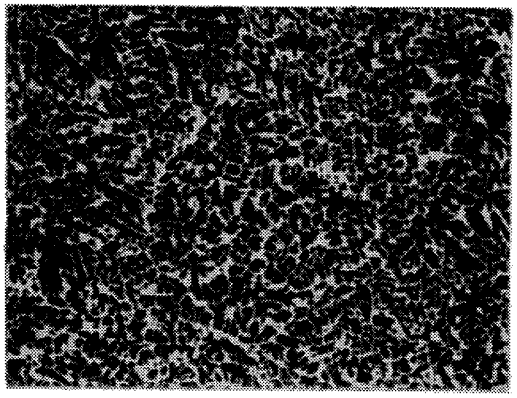
FIGS. 1B, 1C and 1D are photomicrographs of cast microstructures of examples of the alloy of this invention.
Figure 1C:
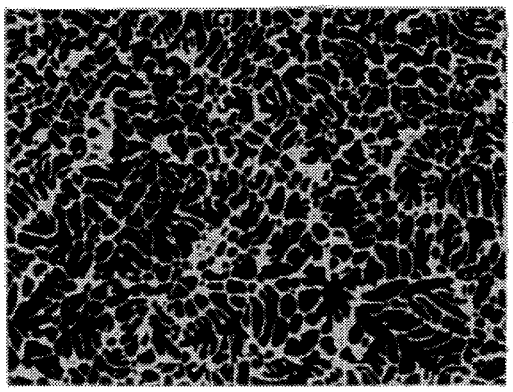
Figure 1D:
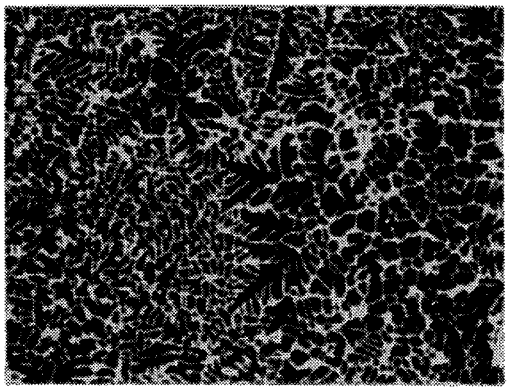
Figure 2A:
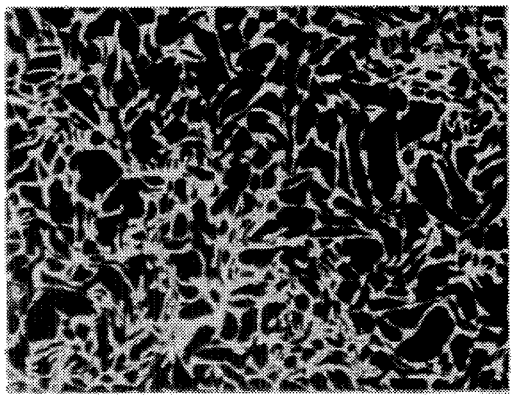
FIGS. 2A, 2B, 2C and 2D are photomicrographs of a microstructure from an extruded alloy of this invention.
Figure 2B:
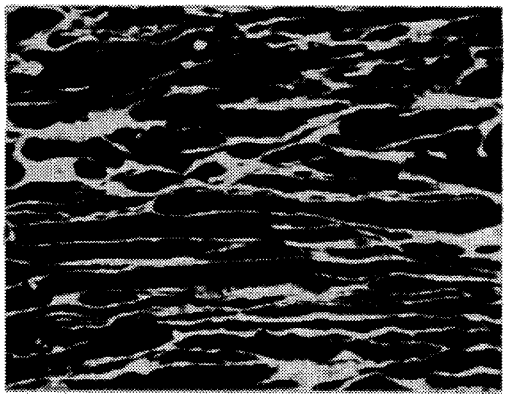
Figure 2C:
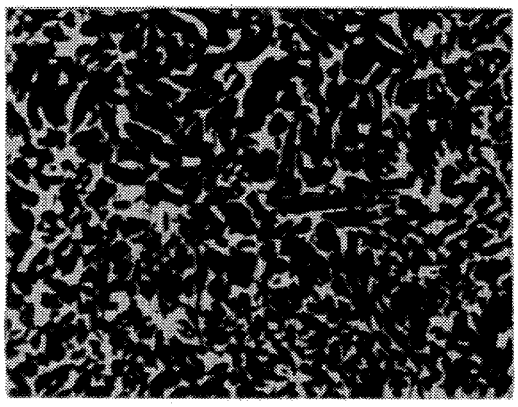
Figure 2D:
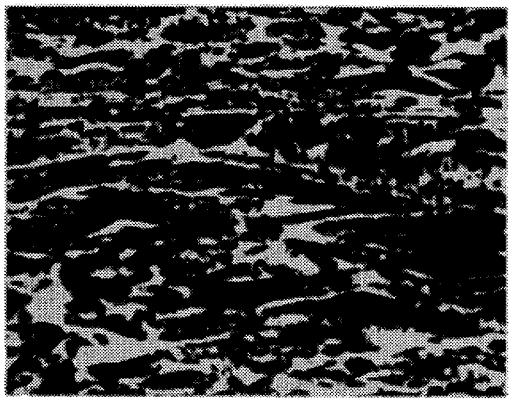

This invention may include a ternary or higher-order cast beryllium-aluminum alloy comprising approximately 60 to 70 weight % beryllium, silicon and/or silver, with the silicon present in approximately 0.5 to 4 weight %, and silver from approximately 0.2 weight % to approximately 4.25 weight %, and aluminum. The alloy so disclosed is an alloy produced by casting. Further strengthening can be achieved by the addition of an element selected from the group consisting of copper, nickel, and cobalt, present as approximately 0.1 to 2.0 weight % of the alloy. When the alloy is to be used in the cast condition, an element such as Sr, or Sb can be added in quantities from approximately 0.005 to 0.200 weight % to improve ductility. The alloy is lightweight and has high stiffness. The density is no more than 2.2 g/cc, and the elastic modulus is greater than 28 million pounds per square inch (mpsi). The aluminum phase surrounds the beryllium phase. And, the aluminum phase typically contains a silicon rich phase and an aluminum silver phase. In the patent to McCarthy, the aluminum phase contains no other constituent phases and interconnected beryllium and aluminum phases.

As described above, beryllium-aluminum alloys have not been successfully cast without segregation and microporosity. Accordingly, it has to date been impossible to make precision cast parts by processes such as investment casting, die casting or permanent mold casting from beryllium-aluminum alloys. However, there is a great need for this technology particularly for intricate parts for aircraft and spacecraft, in which light weight, strength and stiffness are uniformly required.

The beryllium-aluminum alloys of this invention include at least one of silicon and silver. The silver increases the strength and ductility of the alloy in compositions of from 0.2 to 4.25 weight % of the alloy. Silicon at from approximately 0.5 to 4 weight % promotes strength and aids in the castability of the alloy by greatly decreasing porosity. Without silicon, the alloy has more microporosity in the cast condition, which lowers the strength. Without silver, the strength of the alloy is reduced by 25% to 50% over the alloy containing silver. Silver also makes the alloy heat treatable such that additional strengthening can be achieved without loss of ductility through a heat treatment consisting of solutionizing and aging at suitable temperature. The addition of small amounts of Sr, or Sb modify the Si structure in the alloy which results in increased ductility as-cast.

For a wrought alloy whose size and shape is reduced by mechanical deformation after casting, it may not be necessary to have silicon in the composition, as the microporosity is eliminated by compressive forces that are developed during extrusion, rolling, swaging and forging. However, adding silicon even to a wrought alloy greatly increases the strength of the alloy. In either case, with or without Si, wrought alloys do not benefit from the addition of Si modifiers Sr, Na or Sb so that the addition of these elements is not essential to achieving high ductility.

It has also been found that the beryllium phase can be strengthened by including copper, nickel or cobalt at from approximately 0.1 to 2.0 weight % of the alloy. The strengthening element goes into the beryllium phase to increase the yield strength of the alloy by up to 25% without a real effect on the ductility of the alloy. Greater additions of the strengthening element cause the alloy to become more brittle.

For applications in which cast shapes are not required, it has been found that cast and wrought alloys may be accomplished by ternary beryllium-aluminum alloys including either silicon or silver in the stated amount. As cast and wrought, these alloys have superior properties to previously fabricated powder metallurgical wrought beryllium-aluminum alloys.

The following are examples of nine alloys made in accordance with the subject invention:

EXAMPLE I

A 725.75 gram charge with elements in the proportion of (by weight percent) 65Be, 31Al, 2Si, 2Ag, and 0.04Sr was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 22.4 ksi tensile yield strength, 30.6 ksi ultimate tensile strength, and 2.5% elongation. The density of this ingot was 2.13 g/cc and the elastic modulus was 33.0 mpsi. These properties can be compared to the properties of a binary alloy (60 weight % Be, 40 weight % Al, with total charge weight of 853.3 grams) that was melted in a vacuum induction furnace and cast into a mold with a rectangular cross section measuring 3 inches by ⅜ inches. The properties of the binary alloy were 10.9 ksi tensile yield strength, 12.1 ksi ultimate tensile strength, 1% elongation, 30.7 mpsi elastic modulus, and 2.15 g/cc density. The strontium modifies the silicon phase contained within the aluminum. This helps to improve the ductility of the alloy.

EXAMPLE II

A 725.75 gram charge with elements in the proportion of (by weight percent) 65Be, 33A1, and 2Ag was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 19.3 ksi tensile strength, 27.3 ksi ultimate tensile strength, and 5.0% elongation. The density of this ingot was 2.13 g/cc and the elastic modulus was 32.9 mpsi.

EXAMPLE III

A 853.3 gram charge with elements in the proportion of (by weight percent) 60Be, 39Al, and 1Si was placed in a crucible and melted in a vacuum induction furnace. The molten metal was poured into a mold with a rectangular cross section measuring 3 inches by ⅜ inches, cooled to room temperature, and removed from the mold. Tensile properties were measured on this material in the as-east condition. As-east properties were 14.4 ksi tensile strength, 15.9 ksi ultimate tensile strength, and 1.0% elongation. The density of this ingot was 2.18 g/cc and the elastic modulus was 23.5 mpsi.

EXAMPLE IV

A 725.75 gram charge with elements in the proportion of (by weight percent) 65Be, 31Al, 2Si, 2Ag, and 0.04Sr was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 20.1 ksi tensile yield strength, 27.6 ksi ultimate tensile strength, and 2.3% elongation. The density of this ingot was 2.10 g/cc and the elastic modulus was 33.0 mpsi.

A section of the cast ingot was solution heat treated for 2 hours at 550° C. and water quenched, then aged 16 hours at 190° C. and air cooled. Tensile properties of this heat treated material were 23.0 ksi tensile yield strength, 31.6 ksi ultimate tensile strength, and 2.5% elongation. The elastic modulus was 32.7 mpsi.

EXAMPLE V

A 725.75 gram charge with elements in the proportion of Coy weight percent) 65Be, 31Al, 2Si, 2Ag, 0.25Cu and 0.04Sr was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 21.8 ksi tensile yield strength, 30.2 ksi ultimate tensile strength, and 2.4% elongation. The density of this ingot was 2.13 g/cc and the elastic modulus was 33.0 mpsi.

A section of the cast ingot was solution heat treated for 2 hours at 550° C. and water quenched, then aged 16 hours at 190° C. and air cooled. Tensile properties of this heat treated material were 25.8 ksi tensile yield strength, 34.9 ksi ultimate tensile strength, and 2.5% elongation. The elastic modulus was 32.4 mpsi.

EXAMPLE VI

A 725.75 gram charge with elements in the proportion of (by, weight percent) 65Be, 31Al, 2Si, 2Ag, 0.25 Ni and 0.04Sr was placed in a crucible and melted in a vacuum induction furnace. The molten metal was poured into a 1.625 inch diameter cylindrical mold, cooled to room temperature, and removed from the mold. Tensile properties were measured on this material in the as-east condition. As-cast properties were 21.6 ksi tensile yield strength, 27.8 ksi ultimate tensile strength, and 1.3% elongation. The density of this ingot was 2.13 g/cc and the elastic modulus was 32.9 mpsi.

A section of the east ingot was solution heat treated for 2 hours at 550° C. and water quenched, then aged 16 hours at 190° C. and air cooled. Tensile properties of this heat treated material were 26.1 ksi tensile yield strength, 31.9 ksi ultimate tensile strength, 1.8% elongation. The elastic modulus was 32.3 mpsi.

EXAMPLE VII

A 725.75 gram charge with elements in the proportion of Coy weight percent) 65Be, 31Al, 2Si, 2Ag, 0.25Co and 0.04 Sr was placed in a crucible and melted in a vacuum induction furnace. The molten metal was poured into a 1.625 inch diameter cylindrical mold, cooled to room temperature, and removed from the mold. Tensile properties were measured on this material in the as-cast condition. As-cast properties were 22.7 ksi tensile yield strength, 31.2 ksi ultimate tensile strength, and 2.5% elongation. The density of this ingot was 2.14 g/cc and the elastic modulus was 32.7 mpsi.

A section of the cast ingot was solution heat treated for 2 hours at 550° C. and water quenched, then aged 16 hours at 190° C. and air cooled. Tensile properties of this heat treated material were 24.6 ksi tensile yield strength, 32.1 ksi ultimate tensile strength, 1.9% elongation. The elastic modulus was 31.9 mpsi.

EXAMPLE VIII

A 725.75 gram charge with elements in the proportion of Coy weight percent) 65Be, 33Al, and 2Ag was placed in a crucible and melted in a vacuum induction furnace. The molten metal was poured into a 1.625 inch diameter cylindrical mold, cooled to room temperature, and removed from the mold. The resulting ingot was canned in copper, heated to 426° C., and extruded to a 0.55 inch diameter rod. Tensile properties were measured on this material in the extruded condition. Extruded properties were 49.7 ksi tensile yield strength, 63.9 ksi ultimate tensile strength, and 12.6% elongation. The density of this extruded rod was 2.13 g/cc and the elastic modulus was 34.4 mpsi.

A section of the extruded rod was then annealed 24 hours at 550° C. Properties of the rod were 46.7 ksi tensile yield strength, 64.9 ksi ultimate tensile strength, 16.7% elongation. The elastic modulus was 33.5 mpsi.

EXAMPLE IX

A 725.75 gram charge with elements in the proportion of Coy weight percent) 65Be, 32Al, 1Si and 2Ag was placed in a crucible and melted in a vacuum induction furnace. The molten metal was poured into a 1.625 inch diameter cylindrical mold, cooled to room temperature, and removed from the mold. The resulting ingot was canned in copper, heated to 426° C., and extruded to a 0.55 inch diameter rod. Tensile properties were measured on this material in the as-extruded condition. As-extruded properties were 53.0 ksi tensile yield strength, 67.9 ksi ultimate tensile strength, and 12.5% elongation. The density of this extruded rod was 2.13 g/cc and the elastic modulus was 34.8 mpsi.

A section of the extruded rod was then annealed 24 hours at 550° C. Properties of the rod were 51.0 ksi tensile yield strength, 70.4 ksi ultimate tensile strength, 12.5% elongation. The elastic modulus was 35.3 mpsi.

The properties of the alloys presented in the preceding examples are summarized in Table I.

TABLE I

| No. | Composition | Condition | 0.2% YS (ksi) | UTS (ksi) | % E (in 1") | Density (lb/ci) | Elastic Modulus (Mpsi) |
|---|---|---|---|---|---|---|---|
| | 60-Be—40Al | as-cast | 10.9 | 12.1 | 1.0 | .078 | 30.7 |
| I | 65Be—31Al—2Si—2Ag—0.04Sr | as-cast | 22.4 | 30.6 | 2.5 | .077 | 33.0 |
| II | 65Be—33Al—2Ag | as-cast | 19.3 | 27.3 | 5.0 | .077 | 32.9 |
| III | 60Be—39Al—1Si | as-cast | 14.4 | 15.9 | 1.0 | .079 | 23.5 |
| IV | 65Be—31Al—2Si—2Ag—0.04Sr | as-cast | 20.1 | 27.6 | 2.3 | .076 | 33.0 |
| | | heat treated | 23.0 | 31.6 | 2.5 | .076 | 32.7 |
| V | 65Be—31Al—2Si—2Ag—0.25Cu—0.04Sr | as-cast | 21.8 | 30.2 | 2.4 | .077 | 33.0 |
| | | heat treated | 25.8 | 34.9 | 2.5 | .077 | 32.4 |
| VI | 65Be—31Al—2Si—2Ag—0.25Ni—0.04Sr | as-cast | 21.6 | 27.8 | 1.3 | .077 | 32.9 |
| | | heat treated | 26.1 | 31.9 | 1.8 | .077 | 32.3 |
| VII | 65Be—31Al—2Si—2Ag—0.25Co—0.04Sr | as-cast | 22.7 | 31.2 | 2.5 | .077 | 32.7 |
| | | heat treated | 24.6 | 32.1 | 1.9 | .077 | 31.9 |
| VIII | 65Be—33Al—2Ag | as extruded | 49.7 | 63.9 | 12.6 | .077 | 34.4 |
| | | annealed | 46.7 | 64.9 | 16.7 | .077 | 33.5 |
| IX | 65Be—32Al—1Si—2Ag | as extruded | 53.0 | 67.9 | 12.5 | .077 | 34.8 |
| | | annealed | 51.0 | 70.4 | 12.5 | .077 | 35.3 |

FIG. 1 shows a comparison of cast microstructure for some of the various alloys. In these photomicrographs, the dark phase is beryllium and the light phase (matrix phase) is aluminum. Note that the aluminum phase surrounds the beryllium phase. Note the coarse features of the binary alloy compared to 65Be-31Al-2Si-2Ag-0.04 Sr alloy. Additions of Ni or Co cause slight coarsening compared to 65Be-31Al-2Si-2Ag-0.04 Sr, but the structure is still finer than the binary alloy.

Figure 3:
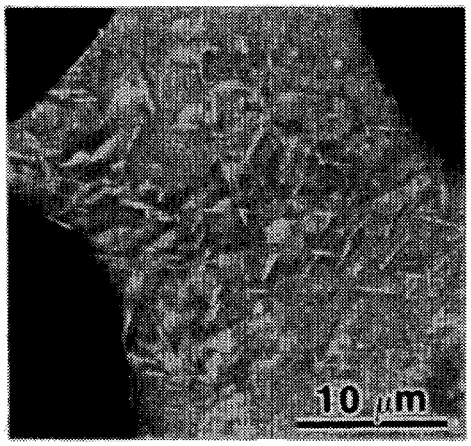
FIG. 3 is a photomicrograph of the distribution of Ag-Al phase in the Al matrix and at the Be-Al interface of the alloy of this invention.

FIG. 2 shows microstructures from extruded 65Be-32Al-1Si-2Ag alloy. As-extruded structure shows uniform distribution and deformation of phases. Annealed structure shows coarsening of aluminum phase as a result of heat treatment. This annealed structure has improved ductility. The Al-Ag phase forms as fine platelets and needles that are uniformly dispersed throughout the matrix Al phase as shown in FIG. 3. The Al-Ag phase also forms directly on the Be phase, surrounding the Be phase, thus limiting the growth of the Be phase which results in a finer, more homogeneous distribution of Be leading to an improved alloy that has higher strength and ductility.

Figure 4:
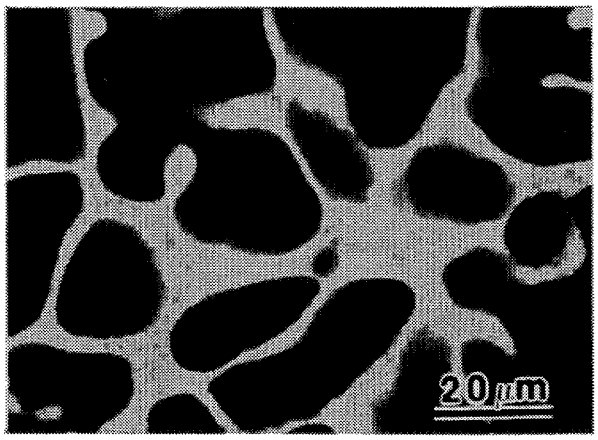
FIG. 4 is a photomicrograph of the distribution of the Si rich phase in the Al matrix of the alloy of this invention.

The Si rich phase forms as a discreet irregularly shaped particle within the Al matrix phase as shown in FIG. 4. The Si particles produce some strengthening of the Al phase. The presence of Si in the Al phase also enhances the strengthening effect of the Al-Ag phase in the alloy. Without the combination of Si and Ag, and the effect that the Al-Ag phase has on modifying the structure of the Be phase, both the strength and ductility of the alloy in the cast condition are below that which is considered useful for an engineering material.

Accordingly, a cast beryllium-aluminum alloy is produced according to this invention rather than an alloy produced by costly liquid phase sintering or solid state synthesis. The aluminum phase of the alloy surrounds the beryllium phase rather than an interpenatrating structure of interconnected beryllium and aluminum phases which results in an alloy with very low ductility. Moreover, the aluminum phase is multiphase and contains a silicon rich phase and an aluminum-silver phase rather than an aluminum phase which contains no other constituent phases.

However, specific features of the invention are shown in some drawings and not others, this is for convenience only as some feature may be combined with any or all of the other features in accordance with the invention. And, other embodiments will occur to those skilled in the art and are within the following claims:

What is claimed is:

1. A cast beryllium-aluminum alloy, comprising:

a beryllium phase and an aluminum phase, silver for refining the microstructure of the alloy, and silicon for improving the compatibility between the beryllium phase and the aluminum phase and aiding in castability, the alloy including approximately 60 to 70% by weight beryllium, from approximately 0.5 to 4% by weight silicon and from approximately 0.2 to 4.25% by weight silver, and the balance aluminum; the aluminum phase containing a silicon rich phase and an aluminum-silver phase, the aluminum phase surrounding the beryllium phase.

2. The alloy of claim 1 further including a beryllium strengthening element selected from the group consisting of copper, nickel, and cobalt in which the strengthening element is included as approximately 0.1 to 2.0% by weight of the alloy.

3. The alloy of claim 1 further including a ductility improving element including one of strontium and antimony in which the ductility improving element is included as approximately 0.005 to 0.200% by weight of the alloy.

4. A cast beryllium-aluminum alloy comprising:

a beryllium phase and an aluminum phase, silver for refining the microstructure of the alloy, and silicon for improving the compatibility between the beryllium and aluminum phases and aiding in castability, the alloy comprising approximately 60 to 70% by weight beryllium, from approximately 0.5 to 4% by weight silicon and from approximately 0.2 to 4.25% by weight silver, and the balance aluminum, the aluminum phase surrounding the beryllium phase.

5. A cast beryllium-aluminum alloy comprising:

A beryllium phase, an aluminum phase, silver for refining the microstructure of the alloy, and silicon for improving the compatibility between the beryllium phase and the aluminum phase and aiding in castability, the alloy comprising approximately 60 to 70% by weight beryllium, from approximately 0.5 to 4% by weight silicon and from approximately 0.2 to 4.25% by weight silver, and the balance aluminum, the aluminum phase containing a silicon rich phase and an aluminum-silver phase.

6. A cast beryllium-aluminum alloy comprising:

A beryllium phase and an aluminum phase, the alloy comprising approximately 60 to 70% by weight beryllium, at least one of silicon and silver in the amount of approximately 0.5 to 4% by weight silicon and from approximately 0.2 to 4.25% by weight silver, and the balance aluminum, the aluminum phase surrounding the beryllium phase.

7. The cast alloy of claim 6 further including a beryllium strengthening element selected from the group consisting of copper, nickel, and cobalt, the strengthening element included as approximately, 0.1 to 2.0% by weight of the alloy.

8. The cast alloy of claim 6 further including a ductility improving element including one of strontium and antimony, the ductility improving element included as approximately 0.005 to 0.200% by weight of the alloy.

9. The cast alloy of claim 6 in which the cast alloy includes both silicon and silver and the aluminum phase includes a silicon rich phase and an aluminum-silver phase.

* * * * *